US008852014B1

(12) United States Patent
Hoang

(10) Patent No.: US 8,852,014 B1
(45) Date of Patent: Oct. 7, 2014

(54) STANDING GOLF SWING TRAINER

(71) Applicant: Ben Hoang, Calgary (CA)

(72) Inventor: Ben Hoang, Calgary (CA)

( * ) Notice: Subject to any disclaimer, the term of this patent is extended or adjusted under 35 U.S.C. 154(b) by 0 days.

(21) Appl. No.: 14/087,402

(22) Filed: Nov. 22, 2013

(51) Int. Cl.
*A63B 69/36* (2006.01)
*A63B 21/02* (2006.01)

(52) U.S. Cl.
CPC ..... *A63B 69/3608* (2013.01)
USPC ..... 473/208; 473/216; 482/124

(58) Field of Classification Search
CPC ..... A63B 69/3608
USPC ..... 473/207, 208, 215, 216, 266, 268, 274, 473/275, 277; 482/69, 121, 124, 127
See application file for complete search history.

(56) References Cited

U.S. PATENT DOCUMENTS 2,737,432 A * 3/1956 Jenks ..... 346/44
3,442,513 A * 5/1969 Fisher et al. ..... 473/208
4,318,546 A * 3/1982 Chen ..... 473/216
4,593,909 A * 6/1986 Anselmo et al. ..... 473/216
5,048,836 A * 9/1991 Bellagamba ..... 473/216
5,924,922 A * 7/1999 Eakin et al. ..... 454/256
6,620,052 B2 * 9/2003 Piatt ..... 473/208
6,843,730 B1 * 1/2005 Bellagamba ..... 473/216

* cited by examiner

*Primary Examiner* — Nini Legesse
(74) *Attorney, Agent, or Firm* — Fish & Richardson P.C.

(57) ABSTRACT

A golf swing training device constructed of flexible material that stretches when deployed and that provides feedback to a user during golf swing execution regarding vertical head movement and hip rotation. The device includes a collar portion, a first tension strap, and a second tension strap. The first tension strap includes a first extension portion being adapted to be disposed along a back of the user from the collar portion down toward a waist of the user and a second extension portion that is adapted to extend from the waist at the user's back to the ground at a predetermined angle, wherein the first tension strap includes a first pass-through region disposed between the first extension portion and the second extension portion. A second tension strap includes a second attachment means at one end and a third attachment means at a second end.

9 Claims, 4 Drawing Sheets

STANDING GOLF SWING TRAINER

TECHNICAL FIELD

The subject matter of this disclosure is related to golf training devices.

BACKGROUND

Golf is a popular sport played by many people around the world of all ages and skill levels. While golf can be enjoyed by anyone, golf is nevertheless a game of skill that requires practice and repetition to reach one's potential. Indeed, the pursuit of lower scores through improved swing mechanics and better "touch" or "feel" for the game is one of the most gratifying aspects of golf. Golfers work on their games in a number of ways such as playing frequent rounds of golf, spending time at the driving range and short-game practice areas, reading literature regarding swing mechanics and mental strategies, and receiving lessons from experienced golfers and golf professionals. Some golfers' practice is facilitated by various training aids that encourage proper swing mechanics.

SUMMARY

The subject matter of this disclosure relates to golf training aids. In general, in one aspect, a training device is disclosed that includes a collar portion sized for placement around a neck of a user, and a first tension strap coupled at one end to the collar portion and including a first attachment means at a second end for attachment to ground. The first tension strap includes a first extension portion being adapted to be disposed along a back of the user from the collar portion down toward a waist of the user and a second extension portion that is adapted to extend from the waist at the user's back to the ground at a predetermined angle, wherein the first tension strap includes a first pass-through region disposed between the first extension portion and the second extension portion. A second tension strap includes a second attachment means at one end and a third attachment means at a second end. The second attachment means is adapted for attachment to a user's waist area and the third attachment means is adapted for attachment of the second tension strap to ground. The second tension strap is adapted to pass through the first pass-through region so as to enable the second tension strap to slide relative to the first tension strap when executing a golf swing. The training device is configured such that, during swing execution, the first tension strap provides feedback to the user when a head of the user moves up or down and the second tension strap provides feedback to the user when hips of the user are rotated.

Embodiments of the subject matter can include one or more of the following features. The collar portion can include a halo that includes a padded portion in an area adjacent to a user's neck. The first and second tension straps can be elastic. The second and third attachment means can include stakes or spikes. The first pass-through region can be a double-strap portion that includes a first portion and a second portion attached, respectively, at each end. The first pass-through region can be adapted to receive the second tension strap so as to pass between the first and second portions.

In some embodiments, the subject matter includes a shoulder portion including a first shoulder cuff and a second shoulder cuff. A third tension strap can couple the first and second shoulder cuffs and pass through a second pass-through region that is positioned in the first extension portion of the first tension strap. A foot portion and a fourth tension strap can also be included, in which the fourth tension strap is adapted for coupling to the first shoulder cuff that is positioned on a leading shoulder of a user and that extends to the foot portion that is coupled to a user's opposing foot. The fourth tension strap can be adapted for extending across the user's chest and abdomen, wrapping around the user's upper leg and lower leg before attaching to the foot portion. The foot portion can be a cuff. The third and fourth tension straps can be adapted to provide feedback to the user during golf swing execution related to shoulder turn.

Embodiments of the disclosed subject matter can realize none, one or more of the following advantages. The training device can be easily adjusted to fit any size user and configured to apply a desirable amount of tension to provide optimal feedback to the user. The training device can be deployed for either right-handed or left-handed golfers. The training device can be easily deployed or disassembled for compact storage. For example, the components of the training device can be made to fit within a pouch or other compartment of a standard golf club bag so that the device may be readily accessible wherever the user takes his/her golf bag and clubs.

DESCRIPTION OF DRAWINGS

Like reference symbols in the various drawings indicate like elements.

DETAILED DESCRIPTION

In general, the subject matter disclosed herein describes a golf training device constructed of a flexible material that can be worn by a user in a manner that resists the user's movement or otherwise provides feedback when the user makes an improper golf swing. Particularly, the device is configured to provide resistance when the user raises her head and does not sufficiently rotate her hips in accordance with a desired golf swing action. In particular embodiments, the device can also encourage the user to properly rotate her shoulders during the swing. That is, when a user attempts to execute a golf swing with improper mechanics, such as by raising her head during the backswing, the user will feel resistance at one or more locations such as at the user's neck or waist. Likewise, if a user winds her hips in one direction during a backswing and fails to unwind or adequately rotate her hips toward the target while completing the swing, then the user will feel tension along her hip or waist area that encourages the user to complete a proper rotation of the hips in a manner that promotes desired swing mechanics. Over time, use of the training device can improve the user's golf swing by creating muscle memory of a proper golf swing through numerous golf swing repetitions while wearing the golf training device and adjusting one's swing so as to reduce the resistance from the device. In some implementations, the golf training aid can be constructed substantially of neoprene, nylon, or other flexible or elastic materials, and/or combinations of these.

Figure 1:
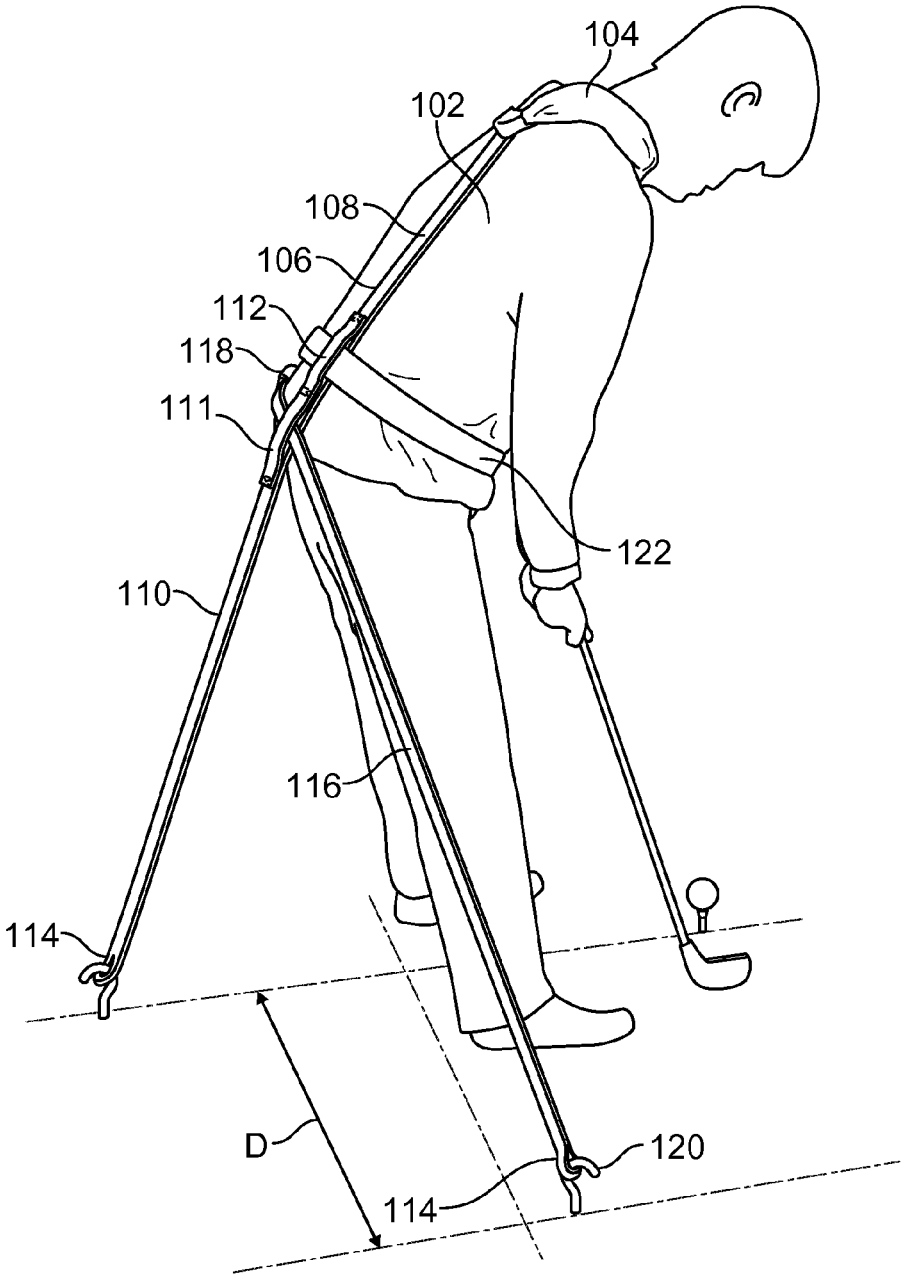
FIG. 1 depicts an example golf swing training device being worn by a user in a golf stance.

Referring now to FIG. 1, an example golf training device 100 is shown being worn by a user 102. In general the training device 100 is configured to be worn along a back side of the user 102. The training device 100 includes a number of different components that interact with each other so as to provide resistive feedback to the user 102 when performing a golf swing. For instance, the training device 100 is shown as including a collar portion 104 that sits around the neck of the user 102, a first tension strap 106 that is coupled at one end to the collar portion 104, and that is coupled at a second end to ground by way of a first attachment means 114. The first tension strap 114 generally resists the user 102 from standing taller during the golf swing and vertically raising her head. The training device 100 also generally includes a second tension strap 116 that is coupled at one end near a left hip of the user 102, passes through a pass-through region 111 of the first tension strap 106, and is coupled at a second end to ground using a third attachment means 120. The example device 100 depicted in FIG. 1 is particularly configured for a golfer that swings right-handed. However, other implementations may also be configured for left-handed golfers. For instance, the second tension strap 116 can be coupled at one end near a right-side of the hip of the user 102, extend across the user's back through the pass-through region 111, and be coupled to ground on a left side of the user for a left-handed golfer. Particular configurations of the golf training aid 100 are described in more detail below.

The training device 100 can include a number of different components that can be attached to each other so as to restrict certain motion of the user 102 when executing a golf swing and to promote desired swing mechanics such as the ability to stay vertically level during the swing without raising one's head, and to rotate one's hips toward a target of the golf swing during the downswing (forward swing) motion by the user 102 without substantial lateral motion toward the user's left side 102 (or toward the right-side for a left-handed golfer). The first tension strap 106 and second tension strap 116 can be constructed using a flexible material that provides resistance when stretched. As a result, when the user 102 wearing the device 100 executes a golf swing with improper swing mechanics, such as by failing to stay level during the course of the swing or not rotating the hips properly toward the target, the flexible material of the first and second tension straps 106 and 116, respectively, can tighten and thereby provide feedback to the user 102 about the improper swing mechanics. The user 102 can then make appropriate corrections in her swing to avoid encountering resistance from the training device 100. By causing the user 102 to avoid resistance during her swing, the training device 100 thereby promotes proper swing mechanics.

In some cases, a user 102 can at first be trained to use the device 100 by a swing expert such as a golf teaching professional. Initial training on the device 100 with a swing expert may be beneficial to the user 102 to ensure that the various components of the training device 100 are optimally or otherwise properly fitted and worn by the user. For instance, depending on the size of a user 102 or variations among particular users' stances in addressing a golf ball, or other particularities of a user's swing, the training device 102 may be configured for individual users 102 to achieve optimal results. As one example, respective elastic properties of the first tension strap 106 and second tension strap 116 can be selected so as to achieve certain feedback characteristics for the user 102. Fit, for example, can be adjusted by shortening one or more of the tension straps that are provided. In some implementations, a highly elastic configuration may be used that does not prevent the user 102 from moving within a range that deviates from ideal swing mechanics, but that nonetheless provides the user 102 with some measure of resistance to the improper motion so that the user 102 can feel such resistance and strive to minimize or eliminate tension from the device 100. In some implementations, a less elastic configuration may be used in which the first and second tension straps 106, 116 do not stretch an appreciable distance so that the user 102 is prevented from moving outside of proper swing positions an appreciable distance when the training device 100 is properly used. For both less and more elastic tension straps 106 and 116, however, because the user 102 receives feedback in the form of resistance, the user's motion is somewhat restricted, so as to encourage/promote proper swing mechanics. For example, the more the user 102 attempts to raise her head or move laterally without rotating her hips during the downswing, the more resistance the user 102 will feel as she executes her golf swing, and hence the more feedback she will receive.

In some implementations, the training device 100 includes a collar portion 104 to fit around a user's 102 neck and to communicate resistive feedback to the user 102 when she raises her head and begins to stand taller during a golf swing. When deployed, the collar portion 104 is coupled to the first tension strap 106 such that the user can feel on her shoulders and around her neck if she begins to raise her head during the swing, which can lead to a number of problems such as "topping" the golf ball and otherwise making inconsistent contact between the club and the ball. The collar portion 104 can be configured to fit snugly around the user's 102 neck without uncomfortably restricting the user 102. The collar portion 104 may be sufficiently taught such that the user 102 can feel when she moves outside of a proper swing position, but is not so restrictive to prevent the user 102 from completing a full turn during the golf swing with proper swing mechanics. The collar portion 104 can be constructed of a substantially rigid ring piece that is lowered over the user's 102 head and that is configured to contact the user's 102 neck and rest on her shoulders. For example, the collar portion 104 can be constructed of a suitable plastic material such as nylon or polyvinyl chloride. For added comfort, a soft padding material may be used to cover the rigid collar material such as foam, neoprene, or a cloth material. For example, the collar portion 104 may include a halo that has a padded portion adjacent to the user's 102 neck. In some implementations, the collar portion 104 may be constructed to wrap around the user's 102 neck without being placed over the user's head 102. For example, a flexible material may be used to bend around the user's 102 neck, and a fastening means can be used to connect the ends of the collar portion 104 on the backside of the user with the first tension strap 106.

The first tension strap 106 is shown in FIG. 1 as being attached between the collar portion 104 and a point on the ground a determined distance behind the user 102. When worn by the user 102, the first tension strap 106 generally extends in a first extension portion 108 down the back of the user and to the rear of the user's 102 waist. A second extension portion 110 of the first tension strap 106 then extends from the user's 102 waist to ground. The ground end of the first tension strap 106 can include a first attachment means 114 for securing the ground end of the strap 106 to the ground. In some implementations, the first attachment means 114 can be, for example, a loop or other opening at the ground end of the strap 106 that receives a stake, spike, or other object secured to the ground. The first attachment means 114 is operable to secure the first tension strap 106 to the ground so as to withstand the forces incurred while a user 102 performs a golf swing. The first attachment means 114 is also sufficiently secured to the ground to withstand tension forces in the first tension strap 106 resulting from improper swing mechanics such as the user 102 raising her head during a swing, which can exact forces on the first tension strap 106 away from the ground. The first attachment means 114 can be attached to the ground generally near the center of the user's stance between the user's 102 legs and a predetermined distance (e.g., several feet) behind the user 102. The precise positioning of the first attachment means 114 may vary based on a number of factors including the user's 102 height, a preferred posture or stance of the user 102, and the particular club being used with the training device 100. For instance, with longer clubs like a driver, the user 102 may adopt a taller stance and position the first attachment means 114 at a first location (e.g., closer) relative to the user 102 than with a shorter club such as a pitching wedge.

Opposite the ground end, the first tension strap 106 is attached to the collar portion 104. The first tension strap 106 can be attached to the collar portion 104 near the back of the user's 102 neck and high on the user's 102 back. As shown in FIG. 1, the first tension strap 106 is generally fastened at one location to each end of the collar portion 104. An attachment means adapted to receive and secure the first extension strap 106 and the collar portion 104 may be used to couple the first strap 106 to the collar portion 104, such as a metal or plastic piece that binds the ends of each piece together. Alternative attachment configurations between the first strap 106 and the collar portion 104 are also possible. For example, the collar portion 106 can be stitched or glued to the end of the first tension strap 106, or a quick-release connector may be employed for easy connection and disassembly of the first tension strap 106 and the collar portion 104. Other attachment means may be used such as one or more of nylon fabric fasteners, plastic clips, or combinations of these.

The first tension strap 106 may be generally constructed of a flexible and elastic material capable of stretching along its length. The first tension strap 106 can be stretched when worn by the user 102 so as to maintain tension at the user's 102 shoulders and/or neck so that the user can feel increased resistance as she, for example, raises her head and stands too upright during any portion of her golf swing. Suitable materials can include one or more of rubber, polymer-based materials, and fabric, and can be generally elastic. The first tension strap 106 can also include a first pass-through region 111 located near the user's waist between the first and second extension portions 108 and 110. The first pass-through region 111 is configured to receive a second tension strap 116 and allow the second tension strap 116 to slide through the first pass-through region 111 relative to the first tension strap 106 when the user 102 executes a golf swing. The first pass-through region 111 is shown in FIG. 1 in a double-layered configuration having a second layer of strap material stitched or otherwise attached at its ends to a continuous piece of the first tension strap 106 near the transition between the first extension portion 108 and the second extension portion 110. The first pass-through region 111 may also be configured as any other opening that is capable of communicating the second tension strap 116 across the user and to slide through the first tension strap 106 near a predetermined region of the strap 106.

The second tension strap 116 is configured to be worn by the user 102 by attaching to a point around a first side of the user's waist 102 at a first end of the strap 116, extending through the first pass-through region 111 of the first tension strap 106, and being secured to ground at a location to the side of the user 102 opposite the first side of the user's waist. In the illustration of FIG. 1, the training device 100 is arranged for use by a right-handed golfer with the first end of the second tension strap 116 attached to the user's hip on her right side, and the second end of the strap 116 secured to the ground to the right of the user 102. However, the device 100 can easily be configured for a left-handed golfer by attaching the first end of the strap 116 to the user's 102 right hip and extending the strap 116 to be secured to a point on the ground to the left of the user 102 (not shown). When deployed, the second tension strap 116 generally encourages the user 102 to rotate her hips to the left during the forward portion of the golf swing (downswing and follow-through), a desirable motion in golf swing mechanics. Additionally, when the user 102 takes the club back during her backswing, the user's hips will rotate somewhat to the right, thereby tensioning the second tension strap 116. The tension in the second tension strap 116 is released as the golfer rotates her hips in the downswing. Moreover, if the user 102 does not rotate her hips properly or simply sways laterally to the left during the downswing (for a right-handed golfer), the second tension strap 116 will resist the lateral motion, providing feedback to the user 102 that can be felt through the user's hip, which tends to pull the user's hip open toward the target during the downswing.

The second tension strap 116 can be constructed of a flexible material capable of stretching along its length. Suitable materials for the second tension strap 116 include rubber, polymer-based materials, and fabric, or any combination of such materials. The first end of the second tension strap 116 can include a second attachment means 118 for fastening the first end of the strap 116 to the user 102. Particular embodiments of the second attachment means 118 can include one or more of nylon fabric fasteners, plastic clips, quick-release clips, and the like, or a combination thereof. The second attachment means 118 is configured to withstand the forces normally experienced by a user 102 executing a golf swing with proper or improper mechanics, without breaking from a located position on the user 102. A third attachment means 120 is located at a second end of the second tension strap 116 for securing the second end of the strap 116 to the ground. The third attachment means 120 can be implemented similarly or differently from the first attachment means 114 of the first tension strap 106. The third attachment means 120 is configured to hold the second end of the second tension strap 116 near the ground, and may include or be connected to a stake that has been driven into and lodged in the ground. The third attachment means 120 may also be coupled, such as by fastening to, looping around, or hooking onto, any number of other objects that provide stability at or near ground level as the user 102 practices a golf swing.

Each of the first tension strap 106 and the second tension strap 116 may be constructed of a substantially continuous material along its length, or may be comprised of two or more connected pieces. Each of the tension straps 106 and 116 may also include means for adjusting their respective lengths. For example, a ladderlock strap adjuster can be provided for the user 102 to adjust the lengths of the straps 106 and 116 to suit her needs.

In some implementations, the training device 100 can also include a belt 122 that fits around the waist of the user 102. The belt 122 can secure the first tension strap 106 to the user 102 so that the first tension strap 106 remains pressed against the user's 102 back while the user 102 practices one or more golf swings. The belt 122 can pass through a second pass-through region 112 in the first tension strap 106. The second-pass through region 112 can be implemented similarly to the first pass-through region 111. Any suitable opening capable of receiving the belt 122 and to hold the first tension strap 106 against the user 102 may be used. For example, as shown in FIG. 1, a second layer of flexible material can be stitched at its ends to a first layer of the first tension strap 106 such the belt 122 can be fed through a gap between the stitched ends. The second attachment means 118 at the first end of the second tension strap 116 may also be configured to attach to the belt 122 near the user's 102 left side (for a right-handed golfer).

Figure 2:
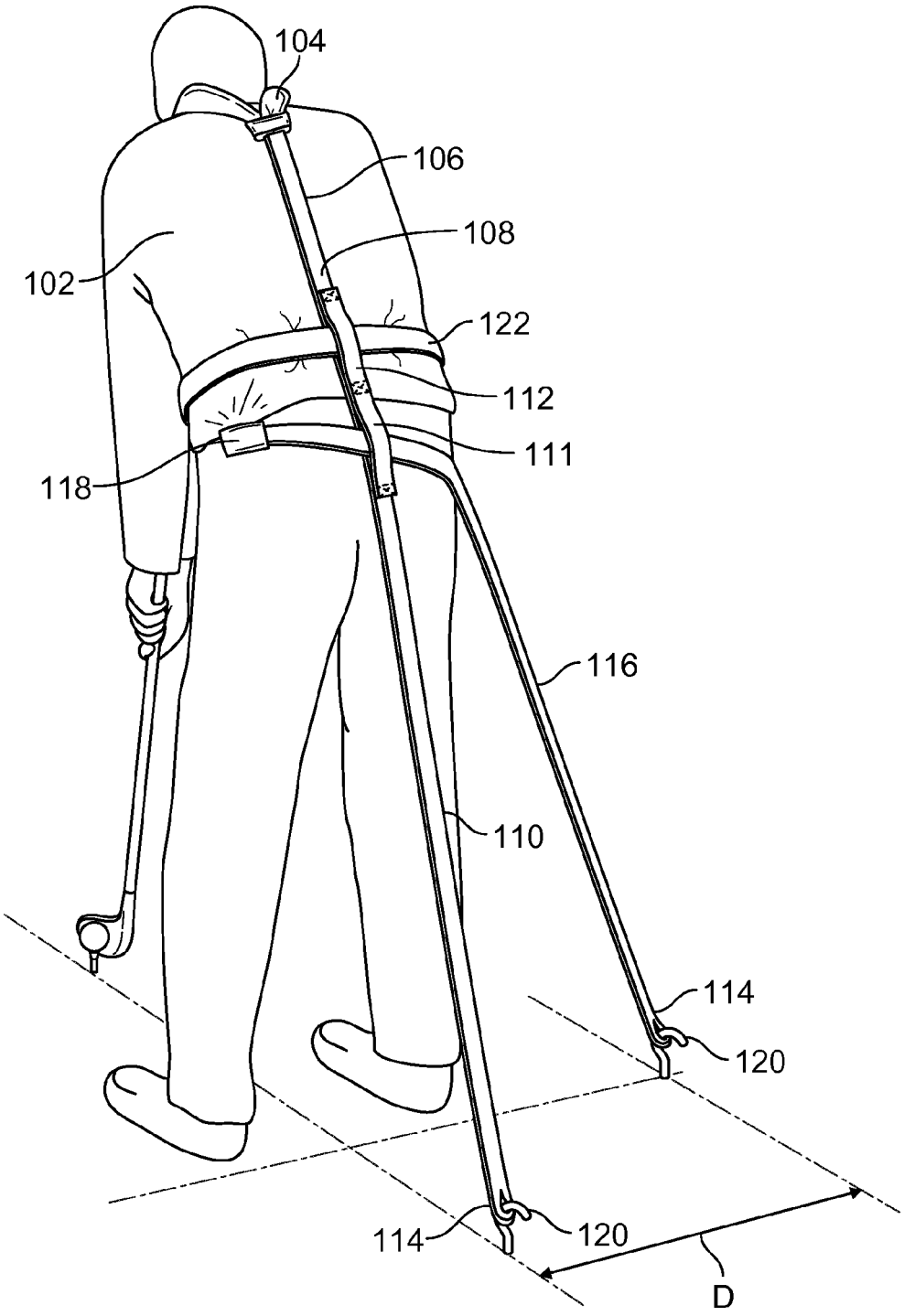
FIG. 2 depicts a rear view of the example golf swing training device being worn by the user.

FIG. 2 shows a rear view of the example swing training device 100. As described above with respect to FIG. 1, the training device 100 can include a first tension strap 106, a second tension strap 116, and a collar portion 104. The device 100 is configured to be worn by a user 102 to promote proper golf swing mechanics including minimal vertical movement (i.e., not raising one's head), and rotation of the hips toward a golf target during a forward swing.

Figure 3:
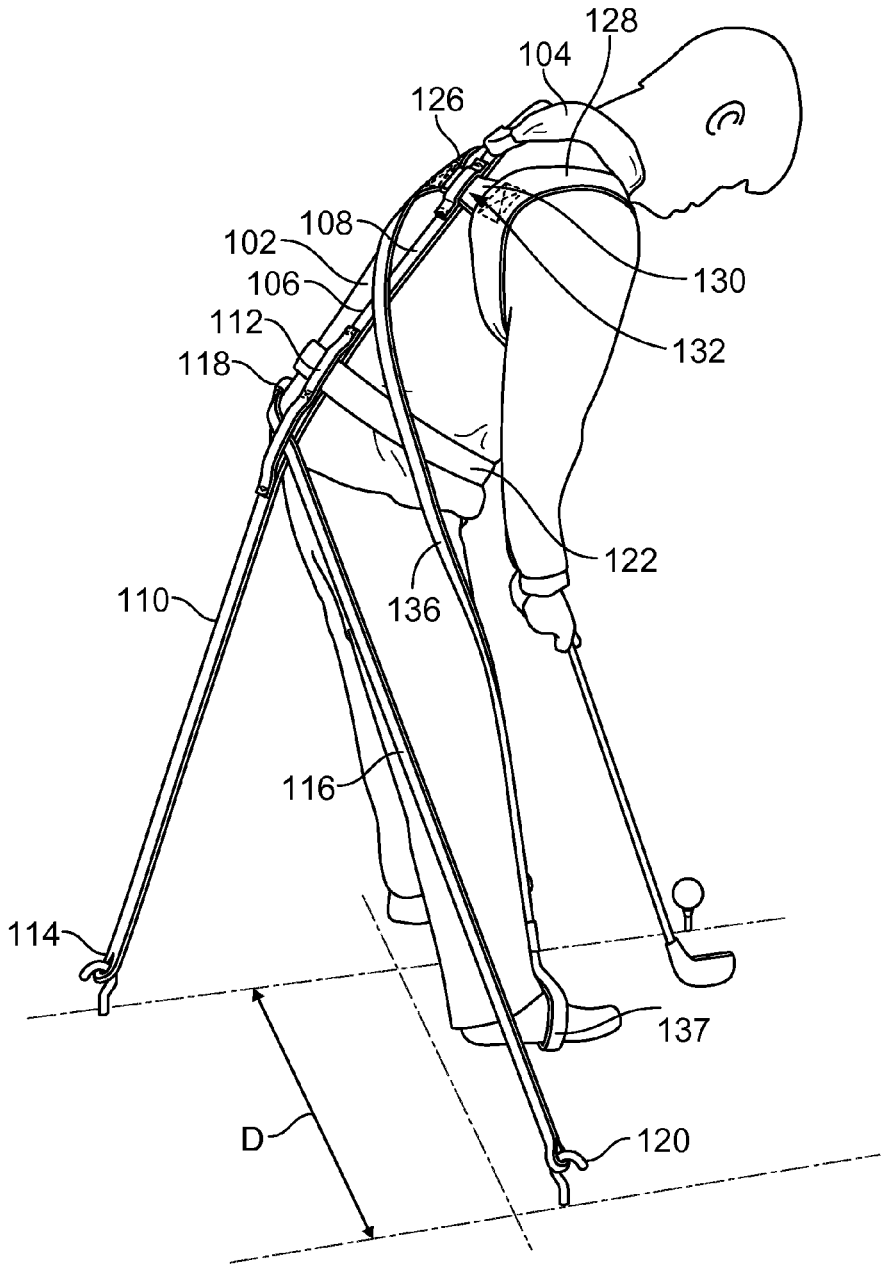
FIG. 3 depicts a side view of the example golf swing training device being worn by the user including a shoulder training assembly.
Figure 4:
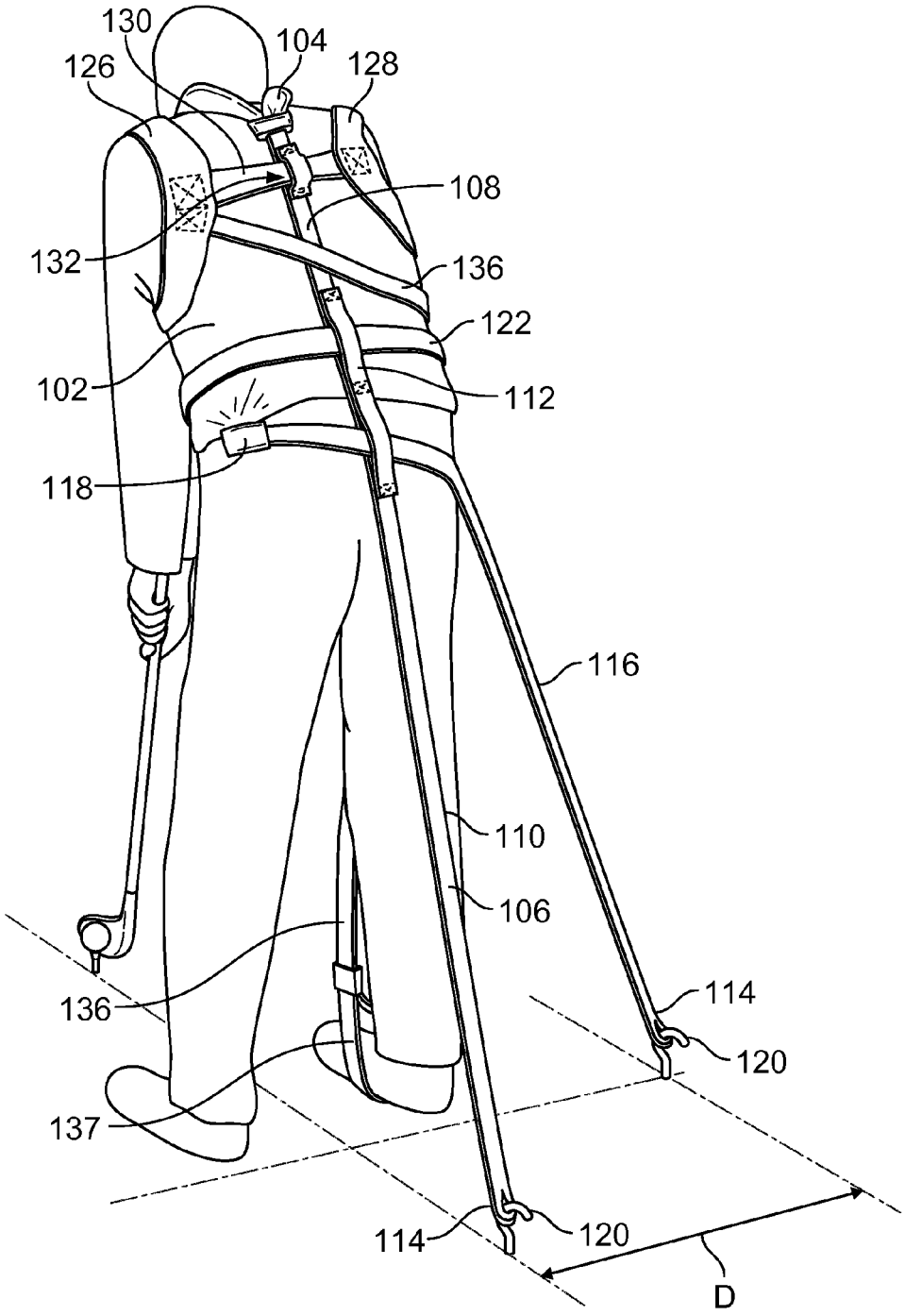
FIG. 4 depicts a rear view of the example golf swing training device being worn by the user including the shoulder training assembly.

With reference to FIGS. 3 and 4, another example implementation of the swing training device 100 is shown that includes an optional shoulder training assembly that can be used to improve a user's shoulder turn when making a golf swing. The shoulder training assembly can be used as part of the training device 100 as described above with respect to FIGS. 1 and 2. For example, the user 102 depicted in FIGS. 3 and 4 is shown as wearing the collar portion 104, first tension strap 106, second tension strap 116, and belt 122, as previously described. In addition, the user 102 is shown wearing the shoulder training assembly that includes a shoulder portion having a first shoulder cuff 126 and a second shoulder cuff 128, a third tension strap 130 coupling the first and second shoulder cuffs 126 and 128, a foot portion 137, and a fourth tension strap 136. In some implementations that are not shown in the drawings, the shoulder training assembly can also be worn and used by the user 102 without the other components of the training device 100. For instance, if a user 102 is particularly interested in practicing the shoulder turn aspects of swing mechanics, then the user 102 could use the shoulder training assembly by itself or with a subset or all of the components of the training device 100.

The shoulder training assembly includes a shoulder portion having a first shoulder cuff 126 and a second shoulder cuff 128. The first shoulder cuff 126 fits around the user's 102 leading shoulder (left shoulder for a right-handed golfer, right shoulder for a left-handed golfer), and the second shoulder cuff 128 fits around the user's 102 opposite shoulder. The shoulder cuffs 126 and 128 can each slide up a respective arm of a user, with a top portion of the cuffs 126, 128 lying over the user's 102 respective shoulders and circling under and around the user's 102 respective arms. Each of the first shoulder cuff 126 and second shoulder cuff 128 can be constructed of a soft, flexible material such as a suitable fabric or neoprene rubber. The shoulder cuffs 126 and 128 are coupled by a third tension strap 130 that runs along the back of the user 102 when deployed. The third tension strap 130 may be stitched, glued, or otherwise permanently connected to the first and second shoulder cuffs 126, 128, or it may be removably attached by using, for example, buttons, clips, or a nylon fabric fastener. As the user wears the shoulder training assembly, the third tension strap 130 is pulled taught between the user's 102 shoulders to help keep the user's shoulders together and pulled back in a proper golf swing position. The third tension strap 130 also facilitates the user's 102 efforts to rotate the shoulders together during a golf swing. The third tension strap 130 can slide through a third pass-through region 132 included in the first tension strap 106, which is located between the first shoulder cuff 126 and second shoulder cuff 128 along the first extension portion 108 of the first tension strap 106.

The shoulder training assembly can also include a fourth tension strap 136. When deployed, the fourth tension strap 136 can be stretched as the user 102 rotates her shoulders during the backswing. As the fourth tension strap 136 is stretched, tension builds in the strap 136, and as one end of the strap 136 can be attached to the first shoulder cuff 126, the tension is communicated to the user's 102 leading shoulder. At the peak of the backswing, the tension in the strap 136 is greatest and the user 102 can then unwind during the downswing to release the tension in the strap 136, rotating her shoulders according to proper swing mechanics. The fourth tension strap 136 can extend from the back of the user's 102 leading shoulder from the first shoulder cuff 126, down across the user's 102 back, and wrap none, one, or more times around the user's back leg (i.e., right leg for a right-handed golfer, left leg for a left-handed golfer). The second end of the fourth tension strap 136 can terminate at or near the user's 102 back foot. For example, as shown in FIGS. 3 and 4, the fourth tension strap 136 includes a foot portion 137 in the form of a loop at its end that receives the user's 102 back foot in order to secure the second end of the fourth tension strap 136 near ground and to resist the tension strap 136 from releasing as the user 102 rotates during a golf swing. The foot portion 137 can also be implemented by other means to secure the second end of the fourth tension strap 136 to the user's 102 back foot or to ground in proximity to the position of the user's back foot such as the means described above with respect to the first and third attachment means 114 and 120, respectively. The foot portion 137 can be a cuff in some implementations. The fourth tension strap 136 can also be configured to be worn by the user 102 in a manner that extends from the user's 102 leading shoulder, across the user's 102 chest and abdomen, and to then wrap around the user's 102 upper and lower leg opposite the user's 102 leading shoulder. In each of the described implementations of the shoulder training assembly, the third tension strap 130 and fourth tension strap 136 are each configured to provide feedback to the user related to shoulder turn during a golf swing.

A number of embodiments of the invention have been described. Nevertheless, it will be understood that various modifications may be made without departing from the spirit and scope of the invention. Accordingly, other embodiments are within the scope of the following claims.

What is claimed is:

1. A training device comprising:

a collar portion sized for placement around a neck of a user;

a first tension strap coupled at one end to the collar portion and including a first attachment means at a second end for attachment to ground, the first tension strap including a first extension portion being adapted to be disposed along a back of the user from the collar portion down toward a waist of the user and a second extension portion that is adapted to extend from the waist at the user's back to the ground at a predetermined angle, wherein the first tension strap includes a first pass-through region disposed between the first extension portion and the second extension portion; and a second tension strap including a second attachment means at one end and a third attachment means at a second end, wherein the second attachment means is adapted for attachment to a user's waist area and wherein the third attachment means is adapted for attachment of the second tension strap to ground, wherein the second tension strap is adapted to pass through the first pass-through region so as to enable the second tension strap to slide relative to the first tension strap when executing a golf swing, wherein:

during swing execution the first tension strap provides feedback to the user when a head of the user moves up or down and the second tension strap provides feedback to the user when hips of the user are rotated.

2. The training device of claim 1, wherein the collar portion includes a halo including a padded portion in an area adjacent to a user's neck.

3. The training device of claim 1, wherein the first and second tension straps are elastic.

4. The training device of claim 1, wherein the second and third attachment means are stakes or spikes.

5. The training device of claim 1, wherein the first pass-through region is a double-strap portion that includes a first portion and a second portion attached respectively at each end and wherein the first pass-through region is adapted to receive the second tension strap so as to pass between the first and second portions.

6. The training device of claim 1, further including:

a shoulder portion including a first shoulder cuff and a second shoulder cuff;

a third tension strap coupling the first and second shoulder cuffs and passing through a second pass-through region that is positioned in the first extension portion of the first tension strap;

a foot portion; and a fourth tension strap adapted for coupling to the first shoulder cuff that is positioned on a leading shoulder of a user and extend to the foot portion that is coupled to a user's opposing foot.

7. The training device of claim 6, wherein the fourth tension strap is adapted for extending across the user's chest and abdomen, wrapping around the user's upper leg and lower leg before attaching to the foot portion.

8. The training device of claim 7, wherein the foot portion is a cuff.

9. The training device of claim 8, wherein the third and fourth tension straps are adapted to provide feedback to the user during golf swing execution related to shoulder turn.

* * * * *